US006296596B1

(12) United States Patent
Alessandri et al.

(10) Patent No.: US 6,296,596 B1
(45) Date of Patent: Oct. 2, 2001

(54) EXERCISE MACHINE FOR EXERCISING THE LOWER LIMBS

(75) Inventors: Nerio Alessandri, Longiano; Massimo Massarini, Cesena, both of (IT)

(73) Assignee: Technogym, S.r.l., Gambettola (IT)

( * ) Notice: Subject to any disclaimer, the term of this patent is extended or adjusted under 35 U.S.C. 154(b) by 0 days.

(21) Appl. No.: 09/504,872

(22) Filed: Feb. 16, 2000

(30) Foreign Application Priority Data

Feb. 17, 1999 (IT) ..... BO99A0066

(51) Int. Cl.[7] ..... A63B 21/06
(52) U.S. Cl. ..... 482/100; 482/97; 482/137
(58) Field of Search ..... 482/100, 97, 137, 482/118, 98, 134, 92–94, 142, 51–52, 130; D21/191, 198

(56) References Cited

U.S. PATENT DOCUMENTS

| | | | | |
|---|---|---|---|---|
| 3,573,865 | | 4/1971 | Annas et al. . | |
| 4,511,137 | * | 4/1985 | Jones | 482/137 |
| 5,106,080 | | 4/1992 | Jones . | |
| 5,106,081 | | 4/1992 | Webb . | |
| 5,527,250 | * | 6/1996 | Chen | 482/96 |
| 5,803,882 | * | 9/1998 | Habing et al. | 482/136 |

OTHER PUBLICATIONS

Hammer Strength Brochure. 482/137 Oct. 1994 (Picture Price List).*

* cited by examiner

*Primary Examiner*—Jerome Donnelly
(74) *Attorney, Agent, or Firm*—Pillsbury Winthrop LLP

(57) ABSTRACT

An exercise machine for exercising the lower limbs; comprising a seating unit for the user, means for supporting the user's feet, opposite to said seating unit, and a load unit operatively connected to said means for supporting the user's feet to exchange power with the user's legs, said means for supporting the user's feet being movable between a position longitudinally approached to said seating unit, and a position longitudinally removed from said seating unit. Said means for supporting the user's feet comprise a first and a second foot board for providing support for a respective foot of the user. Means are provided for actuating said first and second foot boards such that, in correspondence with said approached position to said seating unit, said foot boards are positioned at a maximum transverse distance from each other, and that, in correspondence with said removed position from said seating unit, said foot boards are positioned at a minimum transverse distance, lesser than the previous one.

5 Claims, 3 Drawing Sheets

EXERCISE MACHINE FOR EXERCISING THE LOWER LIMBS

BACKGROUND OF THE INVENTION

The present invention relates to a machine for muscular exercise, validly employable for training the muscles of the lower part of the body, which for the sake of brevity shall be indicated with the term "leg muscles".

Normally, exercise machines for training leg muscles are defined with the term "leg press" and are provided with a frame supporting a load unit, with counter-weight or electrical, with which a user exchanges power through a foot board able to slide along or movable by means of corresponding guides associated to the frame itself. This foot board is opposed to a seating station wherein the user positions him/herself, setting his/her feet onto the foot board itself, performing repetitive exercises of extending and retracting his/her legs.

In known machines, the user's feet push against the foot board while remaining nearly at the same distance, both in the retracted position with the legs bent, and in the extended position with the legs straightened. Proceeding in this manner, one does not obtain, with known machines, an effective exercise for the leg muscles as a whole; for example, the abductor muscles do not receive any significant benefit as a result of the exercise. Moreover, in known machines the ankle area is often subjected, especially in the position with the legs retracted, to excessive and inappropriate stresses and stretching.

SUMMARY OF THE PRESENT INVENTION

The aim of the present invention, therefore, is to eliminate drawbacks present in known machines.

An exercise machine is provided for exercising the lower limbs; comprising a seating unit for the user, means for supporting the user's feet opposite to said seating unit, and a loading unit operatively connected to said means for supporting the user's feet to exchange power with the user's legs, said means of supporting the user's feet being movable between a position that is longitudinally approached to said seating unit, in which the user's legs assume a maximum bending configuration, and a position longitudinally removed from said seating unit, in which the user's legs assume a maximum extension configuration; wherein said means for supporting the user's feet comprise a first and a second foot board for supporting a respective foot of the user, and wherein means are provided for actuating said first and second foot boards so that, in correspondence with said position approached to said seating unit, said foot boards are positioned at a maximum transverse distance from each other lying on mutually converging planes and, in correspondence with said position removed from said seating unit, said foot boards are positioned at a minimum transverse distance, lesser than the previous one, lying mutually co-planar.

With the present machine it is possible to obtain a better training of the leg muscles, with particular involvement of the abductor muscles.

The secondary claims refer to particular and advantageous embodiments of the invention.

BRIEF DESCRIPTION OF THE DRAWINGS

Further features and advantages shall become more readily apparent in the detailed description that follows, made with reference to the accompanying drawings, which represent an embodiment provided purely by way of non limiting example of the present invention, in which.

DESCRIPTION OF THE PREFERRED EMBODIMENTS

Figure 1:
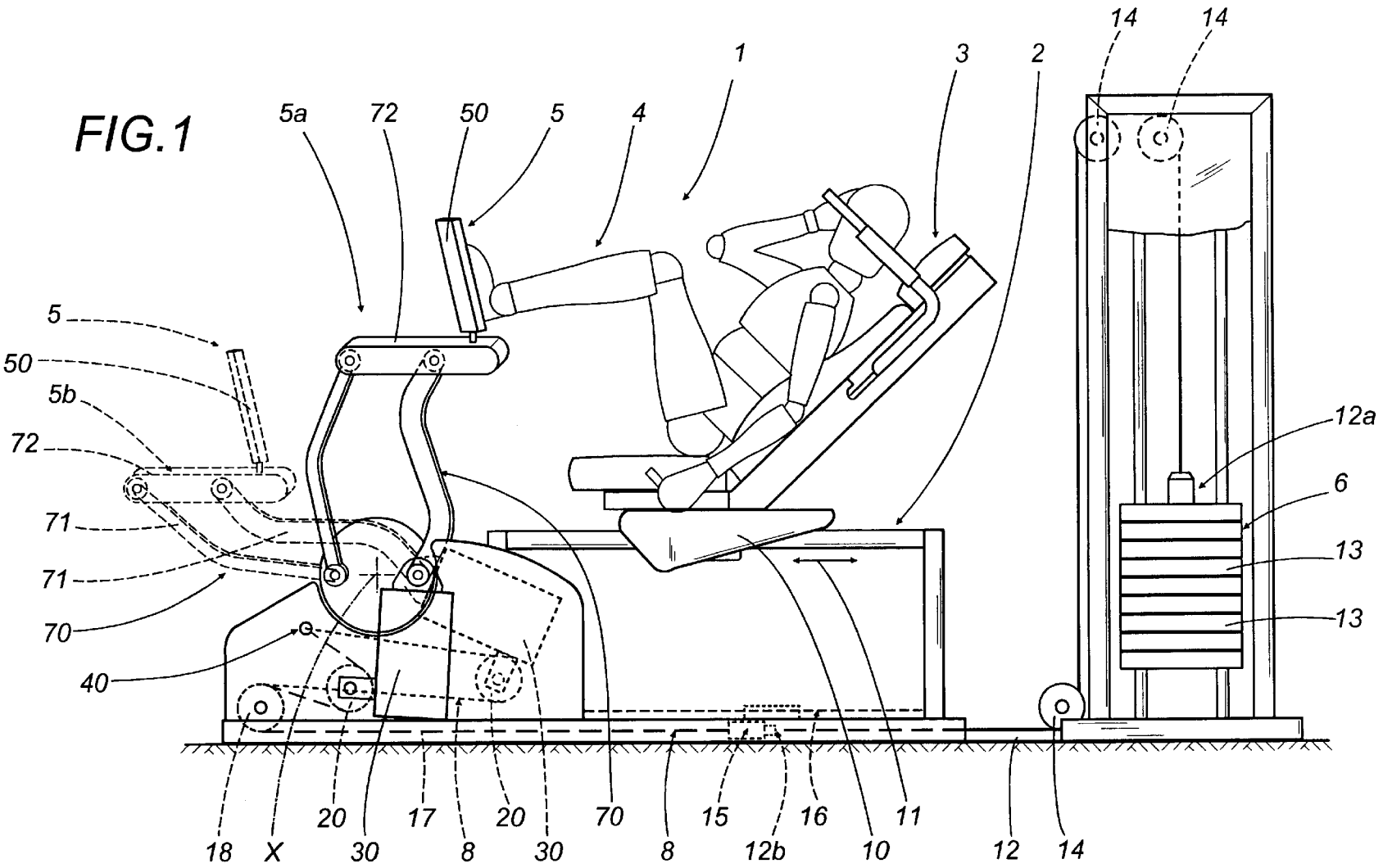
FIG. 1 is a schematic side view of a preferred embodiment of the machine according to the present invention.

In the accompanying FIG. 1, the reference number 1 indicates in its entirety a machine for muscle exercise of the kind normally known by the English term "leg press", meaning a press for leg muscles.

With reference to FIG. 1, the machine 1 comprises a base structure 2 for setting the machine down on the ground, and a seating unit 3 for a user 4, which unit is associated to the structure, in 10, with the possibility of adjustment on the horizontal, according to the arrow 11, according to the anthropomorphic measurements of the user him/herself.

Figure 2:
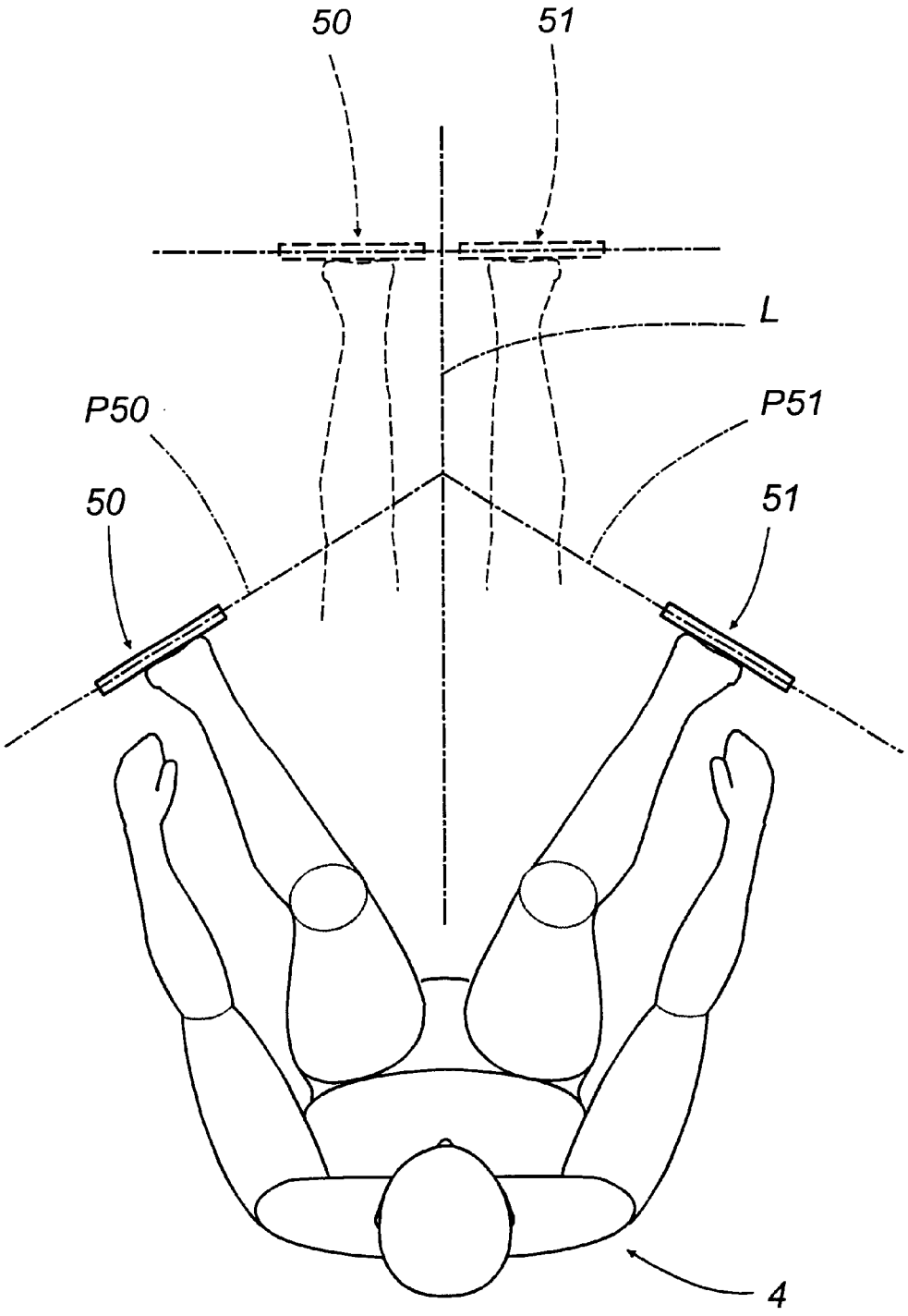
FIG. 2 is a top view schematically showing the converging movement of the foot boards of the preferred embodiment of the machine according to the invention.
Figure 3:
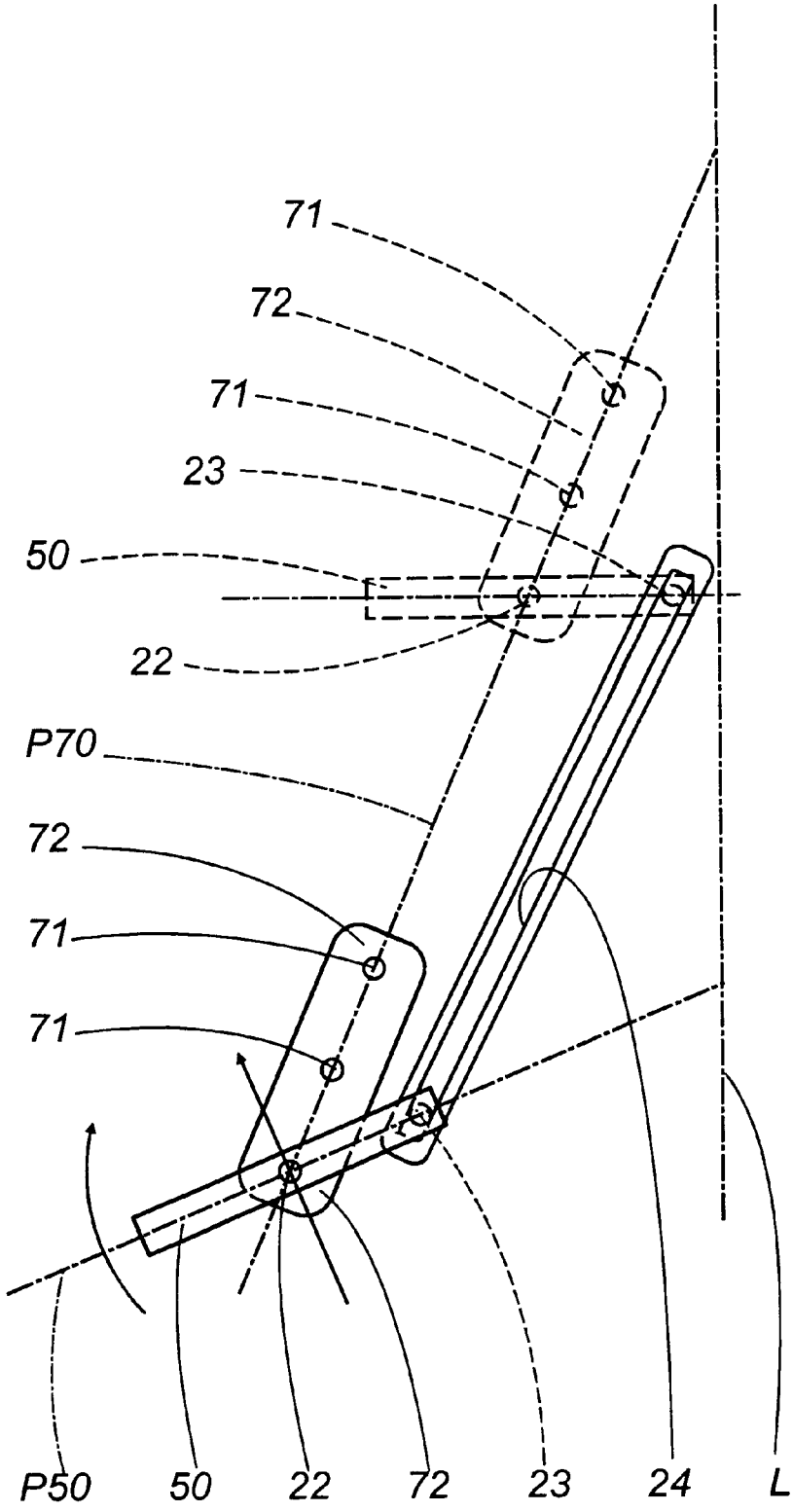
FIG. 3 is a schematic view showing an embodiment of the means that command the rotatory motion of the foot board supporting the user's foot.

As can be seen also with reference to the subsequent FIGS. 2 and 3, the present machine comprises a first and a second foot boards 50, 51, mutually distinct, for supporting a respective foot of the user.

The foot boards 50, 51 are connected and subjected to a load unit 6 which, in the example of FIG. 1, comprises a classic counter-weight element, but which could be of the electrical kind, and with which the user exchanges power.

Said foot boards 50, 51 are distinctly connected to the base structure 2 by means of related kinematic mechanisms 7 with articulated parallelogram which are indicated with the numerical reference 70 in the figures.

As FIG. 1 shows, the kinematic mechanisms are such that each foot board (only the foot board 50 and the related kinematic mechanism 70 being shown in FIG. 1) is able to assume a plurality of positions relatively distanced with respect to the seating unit 3 and variable between a maximum retraction position 5*a*, i.e. approached to said seating unit (shown in continuous line in FIG. 1) and a maximum extension position 5*b*, i.e. removed from said seating unit, which is shown in dashed line in said FIG. 1.

The connection between the two foot boards 50, 51 and the load unit 6 is obtained by means of generic means indicated as 8, which, in effect, are constituted by a first cable 12 wound on first transmission pulleys 14 and fastened, at a first extremity 12*a*, to the weight pack 13 and with the second extremity 12*b* to a sheave 15 (or doubling element) which runs horizontally along a related guide 16 integral to the base structure. Around this sheave 15 is wound a second cable 17, which is, first, subtended to a first pair of second pulleys (constituting a pair in that they are arranged side by side along an axis perpendicular to the plane of the figure and whereof only one, indicated with the numeric reference 18, is actually shown in FIG. 1), and, subsequently, to a second pair of third pulleys (only one indicated with the numeric reference 20 being shown in FIG. 1), which are supported idle by corresponding arms 30 (only one indicated with the numeric reference 30 being shown in FIG. 1) integral with the rotation of the kinematic mechanisms 70 about the axis indicated with the reference X. In FIG. 1, the arm 30, drawn with continuous lines, relates to the configuration of the kinematic mechanism 70 with the foot board approached, whilst the arm 30 drawn with dashed lines relates to the configuration of the kinematic mechanism 70 with the foot board removed. The two ends of the second cable 17 are fastened to the base structure in two points axially offset relative to the perpendicular of the plane of the figure and indicated with a single reference 40. The use of these connection systems allows an advantageous actuation, in independent fashion, of the two foot boards 50 and 51.

As can be observed with reference to FIG. 2, where the reference L indicates the trace of the vertical plane of longitudinal symmetry, each of said first and second foot boards 50, 51 is moved in such a way that, in correspondence with said position 5*a* approached to said seating unit 3, said foot boards 50, 51 are positioned at a maximum transverse distance from each other and that, in correspondence with said position 5*b* removed from said seating unit, said foot boards 50, 51 are positioned at a minimum transverse distance, lesser than the previous one.

As shown, said foot boards 50, 51, in correspondence with said position 5*a* approached to said seating unit 3, lie on mutually converging planes. As shown by the dashed and dotted lines in FIG. 2, marked respectively with the reference P50 and P51, which designated the traces of such convergent planes. This configuration advantageously allows not to stress the ankle in the position with legs retracted.

According to a different embodiment it would, however, also be imaginable that, in correspondence with said position 5*a* approached to said seating unit 3, said foot boards 50, 51 lies substantially co-planar to each other.

As shown in FIG. 2, said first and second foot board 50, 51, in correspondence with said position 5*b* removed from said seating unit, are also positioned in such a way as to lie substantially co-planar to each other.

To move the foot boards 50, 51 in such a way that their trajectories present a transverse component of mutual approach and removal between the foot boards themselves, the vertical arms 71, 71 of each of the articulated parallelograms 70 which bear a respective foot board 50, 51 lie and move on respective planes, of which only one is shown schematically (marked with the reference P70) in FIG. 3, which converge in the longitudinal direction of advance of said foot boards.

In order to obtain, during the advancing and retreating motion of the foot boards 50, 51, the simultaneous rotation of the foot boards themselves from a convergent position to a co-planar position, each foot board 50, 51 is provided with a respective pivot of rotation 22 which is pivotingly engaged to the respective upper horizontal arm 72 of the corresponding articulated parallelogram 70 to rotate relative thereto. Each foot board is then provided with an additional pivot pin 23 able to slide in contact with a corresponding guide 24, which extends substantially in the same direction as the plane P70, whereon lies the motion of the corresponding articulated parallelogram, and which presents a profile suited to obtain the desired rotation of the respective foot board.

Clearly, by means of the illustrated embodiment, it is possible to thrust on the two foot boards in an independent manner or otherwise: if this occurs in a homogeneous manner, i.e. as if the two foot boards 50, 51 moved side by side defining a single body, then the arms 30 of each parallelogram rotate simultaneously, the second cable 17 does not cause the rotation of the sheave and the latter translates horizontally along the guide 16, drawing the first cable 12 by an equal value. If, on the contrary, an offset intervenes between the two foot boards, then the offset is absorbed by the rotation of the sheave 15.

The invention thus conceived can be subject to numerous modifications and variations, without thereby departing from the scope of the inventive concept. Moreover, all components can be replaced by technically equivalent elements.

What is claimed is:

1. Exercise machine for exercising the lower limbs, comprising a seating unit for the user, means for supporting the user's feet opposite to said seating unit, and a load unit operatively connected to said means for supporting the user's feet to exchange power with the user's legs, said means for supporting the user's feet being movable between a position longitudinally approached to said seating unit, in which the user's legs assume a configuration of maximum bending, and a position longitudinally removed from said seating unit, in which the user's legs assume a configuration of maximum extension; wherein said means for supporting the user's feet comprise a first and a second foot board for supporting a respective foot of the user, and in that means are provided for actuating said first and second foot boards, in correspondence with said position approached to said seating unit, said foot boards are positioned at a maximum transverse distance relative to one another, and in that, in correspondence with said position removed from said seating unit, said foot boards are positioned at a minimum transverse distance, lesser than the previous one.

2. A machine as claimed in claim 1, wherein, in correspondence with said position approached to said seating unit, said foot boards lie on mutually converging planes.

3. A machine as claimed in claim 1, wherein, in correspondence with said position approached to said seating unit, said foot boards lie substantially co-planar to each other.

4. A machine as claimed in any of the previous claims, wherein, in correspondence with said position removed from said seating unit, said foot boards lie substantially co-planar to each other.

5. A machine as claimed in any of the previous claims, wherein said first and second foot boards are connected independently to a related kinematic mechanism for the association to said base structure and able, said first and second foot boards, to be activated, each, by a related foot of the user; means being provided for connecting said first and second foot board to said load unit.

* * * * *